US005515652A

United States Patent [19]

Klimek

[11] Patent Number: 5,515,652

[45] Date of Patent: May 14, 1996

[54] DOUBLE HUNG WINDOW

[75] Inventor: David J. Klimek, Wausau, Wis.

[73] Assignee: SNE Enterprises, Inc., New York, N.Y.

[21] Appl. No.: 297,013

[22] Filed: Aug. 29, 1994

[51] Int. Cl.[6] ..... E06B 3/00

[52] U.S. Cl. ..... 49/501; 49/419

[58] Field of Search ..... 49/501, 504, 414, 49/419, DIG. 2, 454, 453

[56] References Cited

U.S. PATENT DOCUMENTS

| | | | |
|---|---|---|---|
| 4,096,665 | 6/1978 | Ellingson, Jr. | 49/414 X |
| 4,558,536 | 12/1985 | Dunsmoor | 49/501 X |
| 4,726,148 | 2/1988 | Tix | 49/453 |
| 4,982,530 | 1/1991 | Palmer | 49/504 |
| 4,993,188 | 2/1991 | Erickson et al. | 49/454 X |
| 5,072,547 | 12/1991 | DiFazio | 49/504 |
| 5,081,793 | 1/1992 | Mauro | 49/501 |
| 5,099,624 | 3/1992 | Valentin | 49/501 X |
| 5,111,621 | 5/1992 | Meyers | 49/504 X |

*Primary Examiner*—Philip C. Kannan
*Attorney, Agent, or Firm*—Gerald S. Geren

[57] ABSTRACT

There is disclosed herein a double hung window assembly which includes a frame and a pair of vertically moveable pane carrying sash members. The frame is a multi-chambered structural plastic extrusion with provision for carrying interior decorative members. The frame includes elongated jamb liners of different colors. The sash includes wooden members carried by the plastic extrusion and constructed to define a stop whereby a pane is secured along its edges to the frame and between the stop and the plastic extrusion. The sash plastic members are essentially identical and the wooden stop members are identical for both sashes. The sash includes grooves to engage the jamb liners. Both the frame and sash carry interior wooden members constructed to be received and held in position relative to the plastic members and conceal the plastic members from interior view.

11 Claims, 3 Drawing Sheets

Fig. 1
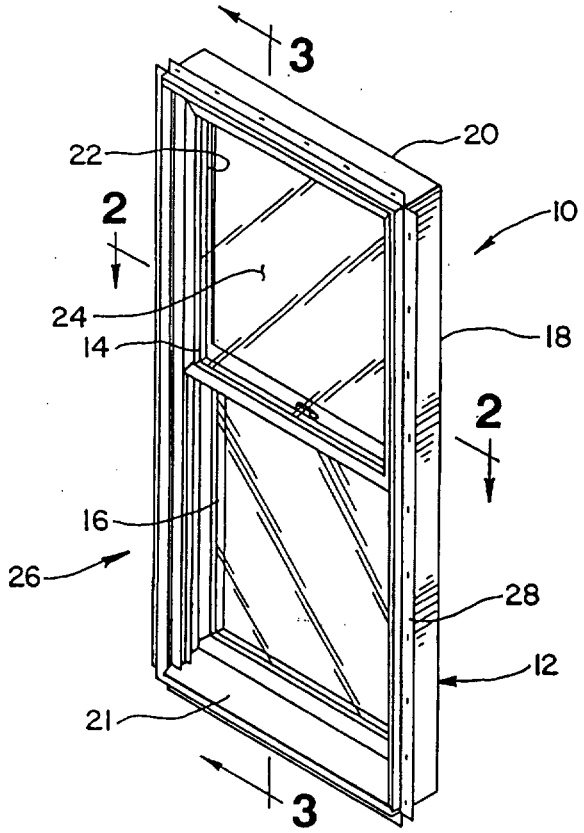
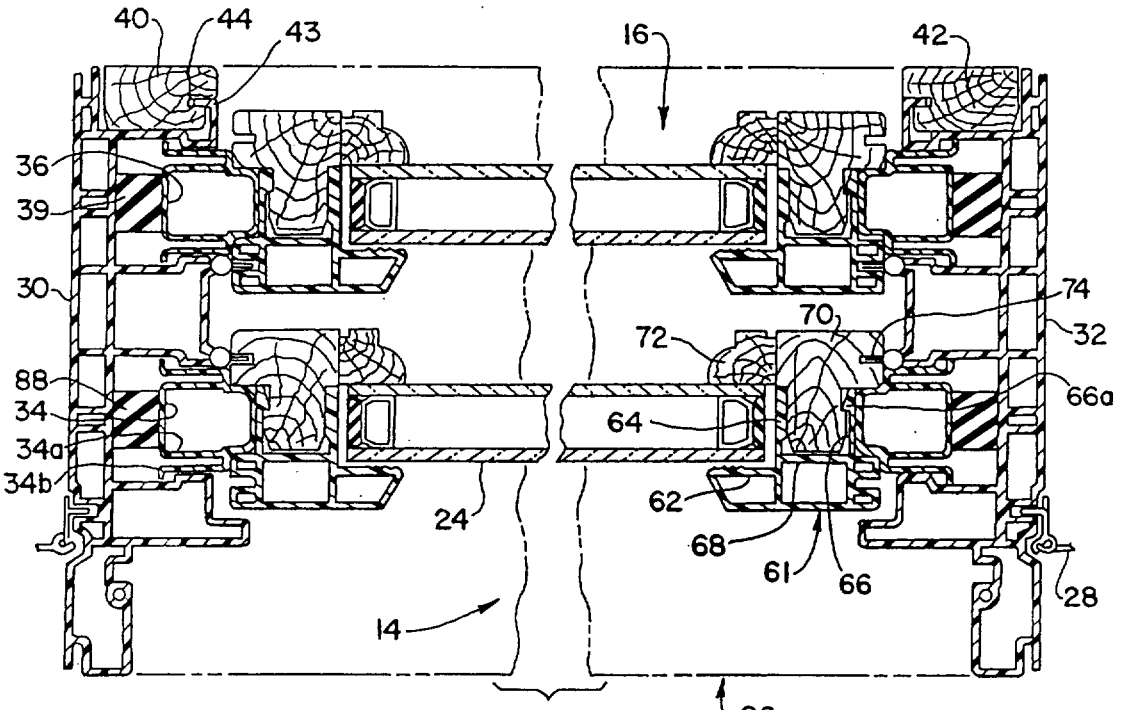
Fig. 2

DOUBLE HUNG WINDOW

BACKGROUND OF THE INVENTION

This invention relates to a double hung window assembly of the type which include a frame for mounting in a building opening and which carries a pair of slideable or moveable sash members.

Presently it is desirable that a window assembly have a plastic or elastomeric exterior for exposure to the weather and a wooden interior for decorative purposes, but the window assembly must be structurally sound and functional. In the past this was accomplished by entirely fabricating the window assembly (i.e. frame and sash members) of wood. Then the exterior wood which would be exposed to the weather was clad with a weather resistant material such as aluminum, polyvinylchloride (PVC) or other elastomer. The belief is that these cladding materials will degrade less than wood when exposed to weather. The window interior assembly was still wooden for esthetic and decorative reasons.

The reduced availability and high cost of wood has increased the motivation to decrease the amount of wood used, be sure there is wood for the interior decoration, and maximize the use of structural plastic materials.

This has led to the increased use of extruded plastic materials such as PVC, which have multiple cavities and are sound structural members. The cavities and their related walls or webs, are intended to reduce weight without sacrificing strength.

Various structures have been suggested for utilizing the wood/extruded plastic combination.

However, it has been found to be desirable to provide a double hung window assembly where each pane carrying sash member includes a plastic exterior and wooden interior and where wooden stops cooperate with the plastic to retain the pane in position and the stops are essentially identical for each sash.

Thus, it is an object of this invention to provide a double hung window assembly, which employs a pair of moveable sashes wherein the pane for each sash is held in position by a plastic structural member and wooden stop that is essentially identical for each sash.

Present double hung window assemblies include a frame in which the sash engaging sides or jambs are of the same color both on the interior and exterior, that is where the frame engages the sash.

It is another object of this invention to provide differently colored jamb or jamb liners that have interior and exterior colors.

Present window frames using multi-chambered plastic elements may expose the plastics to the interior. This exposure can create esthetic and even decorating problems.

Thus, it is yet another object of this invention to provide a frame for a double hung window construction, which minimizes plastic exposure to the interior but maximizes wood exposure.

These and other objects of this invention will become apparent from the following description and appended claims.

SUMMARY OF THE INVENTION

There is disclosed herein a double hung window assembly, which addresses the foregoing objects.

The window assembly includes a frame which carries a pair of moveable sashes. Each sash includes a sash frame that surrounds edges of a transparent pane. Both the frame and sash are constructed of extruded multi-chambered structural plastic and wood. Wooden stops engage the pane and secure the pane to the sash. The stops are essentially identical and can thus be used interchangeably.

The double hung window assembly is constructed so that wooden members are secured to the plastic members, the wooden members are exposed to the interior of the building and the wooden members conceal the plastic from interior view. But, the plastic members are exposed to the exterior. In this way the quantity of wood required is minimized, but appearance considerations are maximized. Moreover, this arrangement allows the flexibility to use various species of wood.

The frame also includes vertical side edges or jambs which engage the sashes and along which the sashes move. These frame edges include elements referred to as the jamb liners, with one jamb liner for each sash. The jamb liner is a horizontally biased plastic member and there is an exterior color for the exterior jamb liner and an interior color for the interior jamb liner.

BRIEF DESCRIPTION OF THE DRAWINGS

FIG. 1 is a perspective view of a double hung window having a frame enclosing a pair of moveable sashes;

FIG. 2 is a horizontal sectional view taken substantially along lines 2—2 of FIG. 1 showing the interior structure of the window but showing both sashes in section as if the lower sash had been raised;

DESCRIPTION OF THE PREFERRED EMBODIMENTS IN GENERAL

Figure 3:
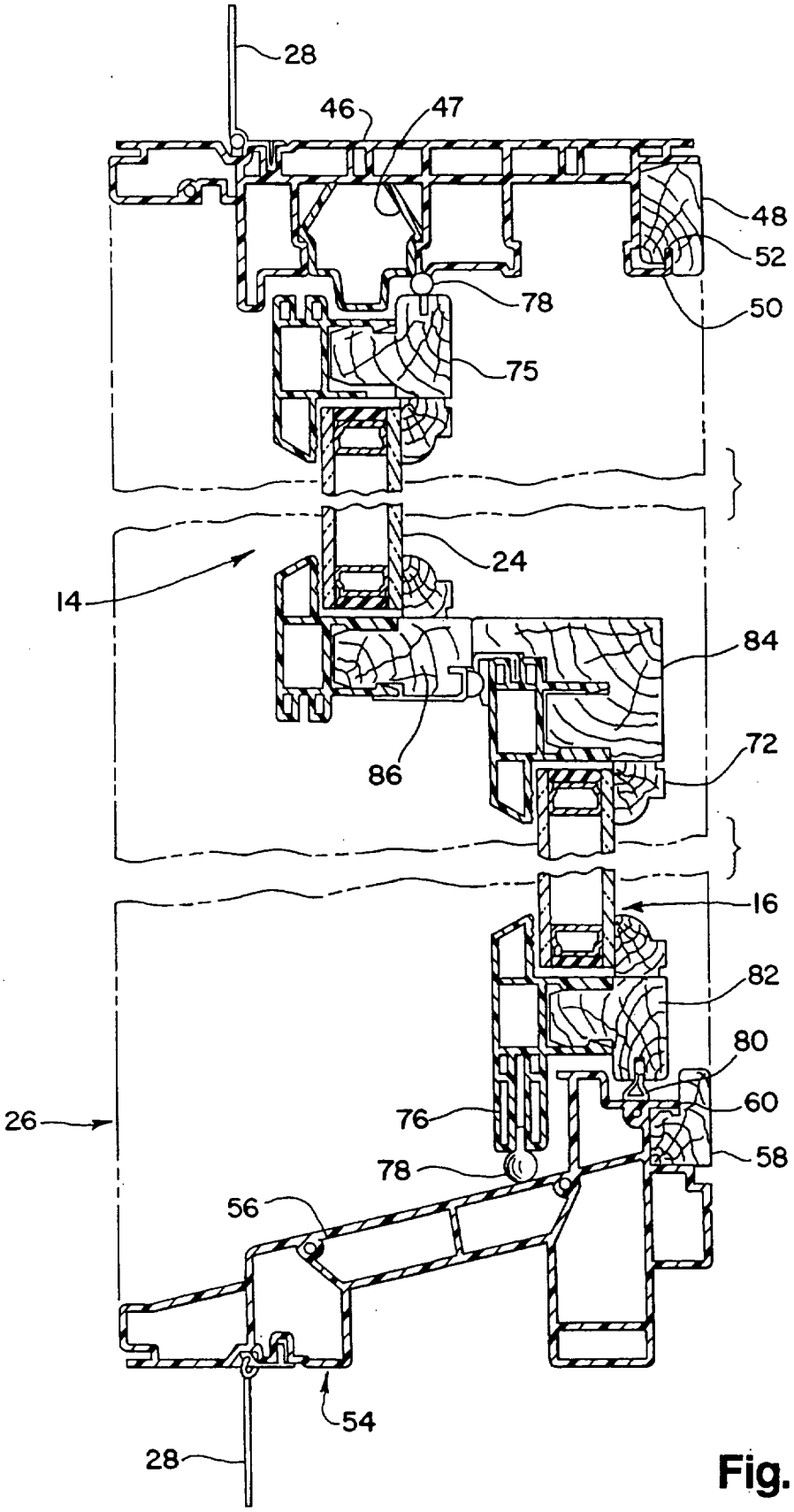
FIG. 3 is a vertical sectional view taken substantially along line 3—3 of FIG. 1 showing the interior structure of the window.

Referring now to the drawings, there is shown a double hung window assembly 10 generally. The assembly includes a rectangular frame 12, which is adapted to be set in an opening in a building. The window also includes a pair of vertically, moveable and removable upper and lower sashes 14 and 16 that are moveable within the frame.

THE FRAME

The frame 12 includes a pair of vertical side members, such as 18, which may be referred to as jambs or edges. The frame also includes horizontal top and bottom members, such as 20 and 21. The bottom member 21 is referred to as a sill. Each of the sashes include a somewhat square peripheral frame 22, which surrounds and engages the transparent pane 24. Each of the sashes can be moved upwardly or downwardly in the frame as shown and the sashes can be rotated toward the interior of the building in order to clean the same. The assembly 10 is shown from an exterior position as suggested by the viewing arrow 26, which is intended to be a view line from the exterior of the window or building toward the interior.

The exterior of the window maximizes the use of structural plastic components, so as to minimize weathering effects, whereas the interior effectively uses wooden members, so as to provide the desired decorative appearance.

A nail fin 28 is provided in association with the window frame and is provided for nailing the window frame to the building and providing a air seal there between.

Figure 4:
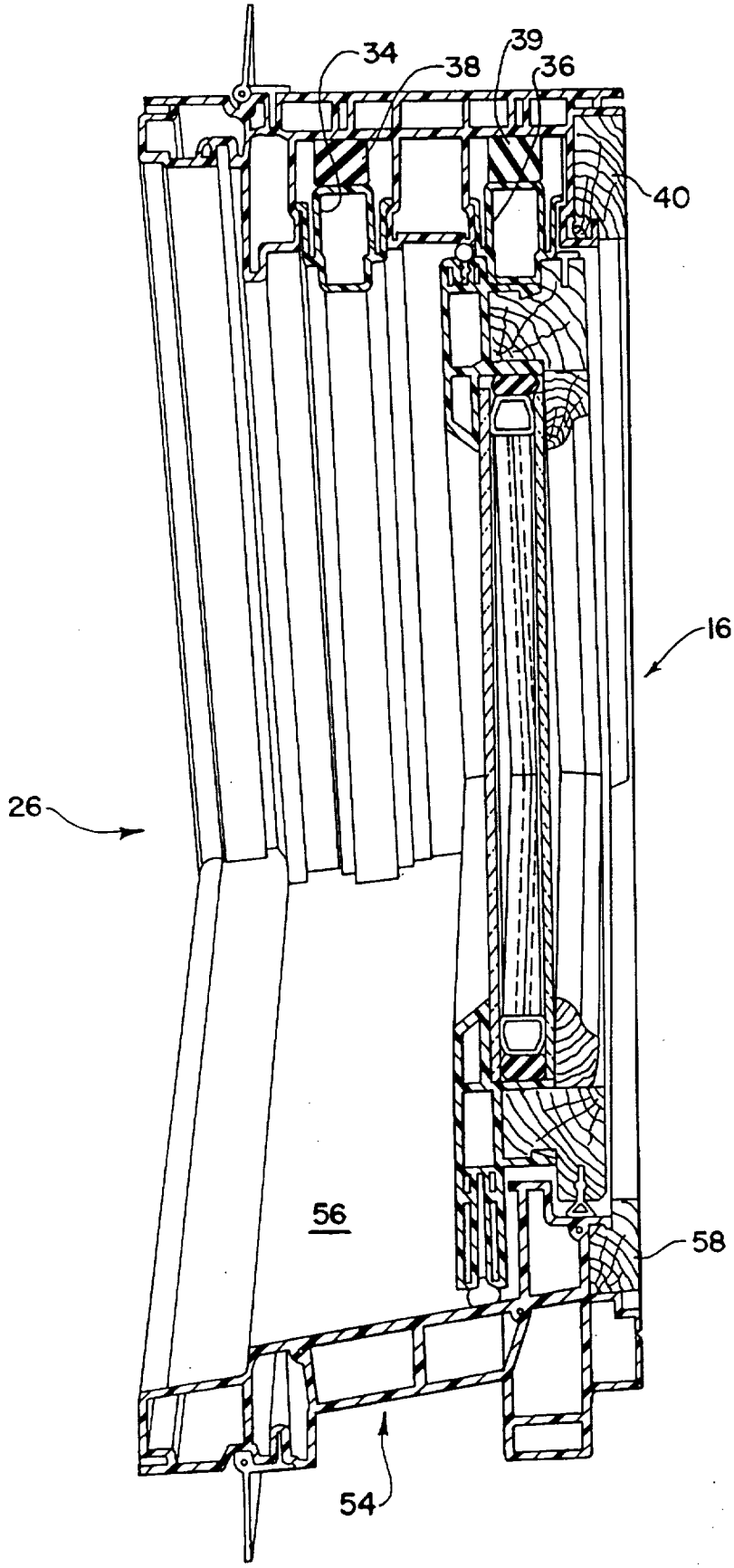
FIG. 4 is a perspective and sectional style view of a lower corner of a window.

The interior of the components for this window will be seen in FIGS. 2, 3 and 4. The frame includes molded plastic, vertical or jamb members 30 and 32. The vertical members such as 30 are provided with the appropriate chamber or cavity and rib or wall construction so as to provide the appropriate structural strength which is needed while still minimizing weight considerations. Each of the vertical members include a pair of horizontally biased jamb liners 34 and 36, which are fitted within the jamb or vertical member 30. The jamb liners such as 34 are elongated tubular, or rectangular members such as 34*a*, which include side restraining wings such as 34*b* that cooperate in the biased movement of the jamb liner toward and away from the vertical. The foam member or biasing spring 38 is positioned between the back of the jamb liner and the back of the frame acts as the bias or spring to urge the jamb liner away from the back and toward the center of the frame. The jamb liner is urged against the sash assembly such as 14 or 16. The attachment of the nail fin 28 to the vertical members is also shown.

Interior vertical wooden members 40 and 42 are seen. These members are principally decorative. Each of the wooden members are received in a recess, formed in the vertical plastic member. Each recess includes a tongue-like latch, such as 43. The latch 43 is intended to cooperate with the groove-like section 44 in the wooden member and permit the wooden member to be received and held to the interior edge of the vertical plastic frame member.

Referring now to the horizontal members of the frame as shown in FIG. 3. It is seen that the top frame member 46 is also a multi-chambered structural member, which includes provisions for the nail fin 28 and an interior recess for receiving the horizontal or wooden head member 48. An appropriate latch 50 and groove 52 is provided for retaining the head member 48 in position. The bottom of the frame is formed by a slopping structural plastic member 54, which forms the exterior sill 56 and includes an interior wood carrying recess for the lower wooden member 58. The member 58 is held in a recess by a latch and groove system 60 similar to that provided above.

The nail fin 28 is also held in position by a groove in the frame members.

The members 30 and 32 are mirror images of one another, but are essentially identical in shape. The top member 46 is essentially identical to the side member 30. Although the top member has a top sash engaging member 47, that engages the top of the top sash 14, in place of the jamb liners such as 34 and 36. The bottom member 54 is differently shaped and needs to be so in order to provide for the sill function of the window.

These four members are fitted and joined together with the side members fitted between the two top and bottom members. The members are then sealed along their joints.

Reference is made to FIG. 4, which shows the frame members 30 and 54 in perspective with the jamb liners 34 and 36 and the biasing springs 38 and 39. The wooden interior frame members 40 and 58 are also seen. In the assembly of the frame, it is essential that the jamb liners 34 and 36 are permitted to move away from the frame back under the biasing action of the foam springs 38 and 39.

Moreover, in the method of extrusion, it has been found that the exterior and interior jamb liners can be formed of different colored plastics. This is by process known as cap-stocking, whereby different colored materials are fed into the extrusion press and result in different colored interior and exterior portions.

It is also seen that from the interior the wood members 40, 48,42 and 58 conceal the plastic frame from interior view and provide the desired decorative appearance.

THE SASHES

Referring now to the sashes, it is seen that the top sash 14 and bottom sash 16 are essentially identical.

Referring first to FIG. 2, it is seen that the exterior of the sash is formed of multi-chambered L-shaped extrusions such as 61 generally. The extrusion 61 defines a short leg 62, which is constructed to engage the side of the pane about the peripheral edge thereof. A second portion of the extrusion defines a second leg 64 which is constructed to engage the peripheral edge of the pane. A third leg 66 is constructed to engage and ride against the jamb liner.

The legs 64 and 66 along with the transverse web 68 form a recess for receiving the wooden member 70 of the sash section. The wooden member is secured by a latch-like interlock system. The wooden member 70 is adapted to be inserted into the recess and snap lock thereto by the barb 66*a* on the leg 66. A wooden sash stop 72 is secured to the decorative wooden member 70 and is positioned against the edge of the pane, such as 24. The decorative wooden member 70 is secured in the recess formed by legs 64 and 66 and web 68. The pane is thus trapped between the leg 62, leg 64 and stop 72.

This structure is found on both the vertical and horizontal edges of the sash. The same type of stop 72 is used as a stop member all about the sash. The plastic member 61 is used around the sash except where the sash engages the sill 56. The presence of the wooden members 70 and 72 provide for the interior decorative appearance and structurally define the seal groove 74 associated with the member 70, as well as the pane stops.

It is seen that essentially the same construction provides for the frame for the other sash.

Referring now to the vertical section as shown in FIG. 3, the sash formation is essentially the same, except in connection with the horizontal top of the interior sash and the lower edge of the outer sash 16. The stop members, such as 72 are essentially the same.

The wooden members such as 70 and 75 on the outer sash 14 also carry a bulbous weather seal, which is adapted to engage the vertical portion of the frame. The lower sash 16 includes a elongated plastic lower portion 76, which carries a bulbous weather sealing portion 78 is adapted to engage the sill 56. Another weather seal 80 is provided in the lower sash 16 by wooden section 82 and the seal engages the lower frame member 54 so as to provide a weather tight seal.

The basic structure for the upper sash lower wooden member 84 and lower sash upper wooden member 86 is very similar to that previously provided and is constructed to cooperate with recesses as had been previously discussed. However, the wooden members 84 and 86 are somewhat differently shaped in order to assure their engagement and air tight sealing cooperation when the window is closed. The wooden member 86 extends slightly more toward the interior than its predecessor members. The member 84 is somewhat U-shaped in order to engage the member 86 and the member 84 extends more outwardly than other similar members.

It will be appreciated that the wooden stop members such as 72 are secured to the wooden members such as 84 by brads or nails. It is seen that the wooden members such as 70 and 72 effectively conceal the plastic from interior exposure.

In construction it will be appreciated that the sash is complete when the plastic members, pane and wooden stop members are secured to each other. Moreover, it will be appreciated that the sashes can be mitered at their edges and heat fused together along the corner so as to form a strong and integral bond and member. Furthermore, this construction lends itself to use with panes of different thickness.

It will be appreciated that numerous changes and modifications can be made to the embodiments herein without departing from the spirit and scope of this invention.

I claim as my invention:

1. A sash for use in a double hung window which includes:

a pane member having a pair of side surfaces and a plurality of peripheral edges which define a periphery;

a structurally integral frame for retaining the pane member about the periphery, said frame constructed of a plurality of elastomeric extrusion members and a plurality of wooden members;

each of said elastomeric extrusion members having a multi-chamber L-shaped cross section, a first leg of the L having an inner surface retaining one side surface of the pane member about the periphery and a second leg of the L having an inner surface retaining a peripheral edge of the pane member, said elastomeric extrusion member also defining a recess for receiving and holding a wooden member;

each of said wooden members shaped to be received and held in said recess and having a stop portion for retaining only the other side surface of the pane member;

so that said pane member periphery is positioned between the stop portion and the first leg of the L about the pane member and so that the other side surface of the pane member is only retained by the stop portion; and wherein each recess forming extrusion includes an interlock member and each wooden member is shaped for receiving the interlock member whereby the extrusion member and wooden member engage and interlock to each other.

2. A sash as in claim 1 wherein the extrusion members are substantially identical for retaining the pane member and interlocking and the wooden members are substantially identical for retaining the pane member and interlocking.

3. A sash as in claim 2 wherein the extrusion members and wood members snap lock together.

4. A sash as in claim 1 wherein said extrusion members are substantially concealed from view through and by the wooden members.

5. A sash as in claim 1 wherein the pane member is rectangularly shaped and has four peripheral edges.

6. A sash as in claim 1 wherein each of the extrusion members is joined to an adjacent extrusion member by a fusion bond.

7. A sash as in claim 1 wherein each of said extrusion members recess includes a third leg spaced from said second leg and substantially parallel thereto, and a transverse web for interconnecting the second leg and third leg so as to define a three-sided recess.

8. A sash as in claim 7 wherein the third leg is constructed to engage a jamb-liner.

9. A sash for use in a double hung window which includes:

a pane member having a pair of side surfaces and a plurality of peripheral edges which define a periphery;

a structurally integral frame for retaining the pane member about the periphery, said frame constructed of a plurality of elastomeric extrusion members and a plurality of wooden members;

each of said elastomeric extrusion members having a multi-chamber L-shaped cross section, a first leg of the L having an inner surface retaining one side surface of the pane member about the periphery and a second leg of the L having an inner surface retaining a peripheral edge of the pane member, said elastomeric extrusion member also defining a recess for receiving and holding a wooden member;

each of said wooden members shaped to be received and held in said recess and having a stop portion for retaining only the other side surface of the pane member;

so that said pane member periphery is positioned between the stop portion and the first leg of the L about the pane member and so that the other side surface of the pane member is only retained by the stop portion;

wherein each of said extrusion members recess includes a third leg spaced from said second leg and substantially parallel thereto, and a transverse web for interconnecting the second leg and third leg so as to define a three-sided recess; and wherein there is provided in combination therewith a frame to be secured to a building, for engaging the sash and for slidable movement of the sash relative to the frame;

said building frame having a pair of vertically oriented stile members and a pair of vertically oriented jamb-liners in each stile member, with each jamb-liner biased toward the sash; and each jamb-liner engaging a sash extrusion member third leg.

10. A sash for a double hung window which includes:

a pane member having a pair of side surfaces and a plurality of peripheral edges which define a periphery;

a structurally integral frame for retaining the pane member about the periphery, said frame constructed of a plurality of elastomeric extrusion members and a plurality of wooden members;

each of said elastomeric extrusion members having a multi-chamber L-shaped cross section, a first leg of the L having an inner surface for retaining one side surface of the pane member about the periphery and a second leg of the L having an inner surface for retaining a peripheral edge of the pane member, and said elastomeric extrusion member also defining a recess for receiving and holding a wooden member;

each of said wooden members shaped to be received and held in said recess, and having a stop portion for retaining only the other side surface of the pane member;

so that said pane member is positioned between the stop portion and the first leg of the L about the pane member and so that the other side surface of the pane member is only retained by the stop portion;

wherein each recess forming extrusion includes an interlock member and said wooden member is shaped for receiving the interlock member whereby the extrusion member and wooden member engage and interlock to each other;

wherein the extrusion members are substantially identical for retaining the pane member and interlocking and the wooden members are substantially identical for retaining the pane member and interlocking;

wherein the extrusion members and wooden members engage and snap lock together;

wherein the pane member is rectangularly shaped and has four peripheral edges;

wherein said extrusion members are substantially concealed from view through and by the wooden members;

wherein each of the extrusion members is joined to an adjacent extrusion member by a fusion bond;

wherein each of said extrusion members recess includes a third leg spaced from said second leg and substantially parallel thereto, and a transverse web for interconnecting the second leg and third leg so as to define a three-sided recess; and wherein the third leg is constructed to engage a jamb-liner.

11. A sash for a window and a building frame in a combination:

a frame to be secured to a building, for engaging a sash and for slidable movement of the sash relative to the frame, said building frame having a pair of vertically oriented stile members and a pair of vertically oriented jamb-liners in each stile member, with each jamb-liner resiliently biased inwardly toward a sash and each jamb-liner engaging said sash;

said sash including:

a pane member having a pair of side surfaces and a plurality of peripheral edges which define a periphery;

a structurally integral sash frame for retaining the pane member about the periphery, said sash frame constructed of a plurality of elastomeric extrusion members and a plurality of wooden members;

each of said elastomeric extrusion members having a multi-chamber L-shaped cross section, a first leg of the L having an inner surface retaining one side surface of the pane member about the periphery and a second leg of the L having an inner surface retaining a peripheral edge of the pane member, and said elastomeric extrusion member also defining a recess for receiving and holding a wooden member;

each of said wooden members shaped to be received and held in said recess and having a stop portion constructed for retaining only the other side surface of the pane member;

so that the pane member is positioned between the stop portion and the first leg of the L about the pane member and so that the other surface of the pane member is only retained by the stop portion;

wherein each recess forming extrusion includes an interlock member and said wooden member is shaped for receiving the interlock member whereby the extrusion and wooden member engage and interlock to each other;

wherein the extrusion members are substantially identical for retaining the pane member and interlocking and the wooden members are substantially identical for retaining the pane member and interlocking;

wherein the extrusion member and wooden member snaplock together;

wherein said extrusion members are substantially concealed from view through and by the wooden members;

wherein the pane member is rectangularly shaped and has four peripheral edges;

wherein the each of the extrusion members is joined to an adjacent extrusion member by a fusion bond;

wherein each of said extrusion members recess includes a third leg spaced from the second leg and substantially parallel thereto and a transverse web for interconnecting the second leg and third leg so as to define a three-sided recess; and wherein the third leg is constructed to engage a jamb-liner and the jamb-liner engage a sash extrusion third leg.

* * * * *